United States Patent [19]

Roper

[11] Patent Number: 4,576,030

[45] Date of Patent: Mar. 18, 1986

[54] STRETCH FORM DIE

[75] Inventor: Ralph E. Roper, Indianapolis, Ind.

[73] Assignee: Wallace Expanding Machines, Inc., Indianapolis, Ind.

[21] Appl. No.: 528,067

[22] Filed: Aug. 31, 1983

[51] Int. Cl.[4] ..... B21D 11/02

[52] U.S. Cl. ..... 72/296; 72/304; 72/305; 72/414; 72/293

[58] Field of Search ..... 72/296, 304, 305, 312-315, 72/293, 414, 415, 412, 350, 417, 347, 348, 326-330, 333-336

[56] References Cited

U.S. PATENT DOCUMENTS

| | | | |
|---|---|---|---|
| 2,043,591 | 6/1936 | Peterson | 72/305 |
| 2,064,160 | 12/1936 | Hochreiter et al. | 72/312 |
| 3,253,448 | 5/1966 | Dolney | 72/305 |
| 3,299,689 | 1/1967 | Dolney et al. | 72/304 |
| 3,314,270 | 4/1967 | Dolney | 72/305 |
| 3,664,172 | 5/1972 | Cvacho | 72/350 |
| 3,789,649 | 2/1974 | Clowes | 72/350 |
| 4,195,510 | 4/1980 | Clowes | 72/350 |
| 4,211,102 | 7/1980 | Hurvitz | 72/304 |
| 4,432,222 | 2/1984 | Ujihara et al. | 72/350 |

FOREIGN PATENT DOCUMENTS

| | | | |
|---|---|---|---|
| 2450624 | 5/1975 | Fed. Rep. of Germany | 72/350 |
| 58-928 | 4/1982 | Japan | 72/350 |

*Primary Examiner*—Daniel C. Crane

*Attorney, Agent, or Firm*—Woodard, Weikart, Emhardt & Naughton

[57] ABSTRACT

An apparatus and method relating to an improved die for homogeneously stretch forming sheet metal in standard sized presses without also drawing the sheet metal. The die is comprised of complementary male and female die halves moveable between open and closed positions, and a blank holder member moveable between open and closed positions relative to the female die half. A pair of grippers having mutually facing surfaces is carried by the female die half and the blank holder member. One of the gripper surfaces defines exactly two rectangular shaped beads which extend entirely around the circumference of the male and female die halves, while the other of the gripper surfaces is flat. The beads are equally spaced apart along their lengths and each includes a pair of relatively sharp edges for biting into the sheet metal.

14 Claims, 4 Drawing Figures

STRETCH FORM DIE

BACKGROUND OF THE INVENTION

The subject invention relates generally to devices for forming a part from sheet metal stock and, more particularly, to a stretch form die operable with standard drawing die presses that can one hundred percent homogeneously stretch form pre-cut sheet metal blanks or sheet metal advanced from a continuous coil.

Various types of devices exist which permit sheet metal stock to be stretched either prior to or during the forming of the sheet metal stock. In some of these devices, the sheet metal is pre-stretched beyond its elastic limit before the sheet metal is formed by a conventional drawing operation. Such devices permit the metal to be formed while the metal is in a more readily formable state. Examples of such devices are disclosed in U.S. Pat. No. 3,253,448 to Dolney and U.S. Pat. No. 3,314,270 to Dolney.

Other devices combine the stretching and drawing operations so that the resulting part is partially stretch formed and partially formed by drawing. Stretch drawing is commonly used in forming automotive doors, panels, hoods and deck lids wherein the metal is relatively thin in relation to the total area of the part, and the use of conventional drawing operations would result in a highly wrinkled part. U.S. Pat. No. 3,299,689 to Dolney et al discloses one example of such a device.

Still other devices form the sheet metal stock by a combination of stretching and slippage effects. U.S. Pat. No. 2,342,437 to Summers discloses one example of such devices. This device discloses a number of hydraulic clamping cylinders operable to exert graduating different pressures on the workpiece. The clamping cylinders permit varying the amount of clamping and slippage along different sections of the sheet metal as it is being formed by the action of a punch. This device, however, is relatively complicated and is limited in use to those applications where the sheet metal can be formed without the need for co-acting of male and female die halves.

In order to improve upon previous methods for forming sheet metal, applicant developed a process wherein the sheet metal was one hundred percent stretch formed between co-acting male and female die halves. This was accomplished by providing a gripper means which operated to totally lock the entire periphery of the sheet metal during closure of the die halves. The upper surface of the gripper means included a set of five spaced apart beads which extended entirely around the periphery of the female die half while the lower surface of the gripper means was made flat. Each of the beads was provided with relatively sharp edges which bit into the sheet metal when the grippers were closed. This type of gripper means permitted the sheet metal to be homogeneously stretch formed, thus resulting in a higher quality of shape retention in the finished part and also a materials savings. One notable disadvantage, however, which considerably restricted the application of this method was that the footprint left by the grippers was exceedingly large. This meant that a very high stamping pressure needed to be exerted in order to totally prevent any slippage of the metal. As a result, standard sized presses normally used to form parts otherwise suitable for forming by this method could not achieve the necessary clamping pressure.

In accordance with the subject invention, the gripper means has been modified so that it is now possible to homogeneously stretch form sheet metal using conventional standard sized presses now used to form parts, otherwise suitable for this method, by conventional techniques.

SUMMARY OF THE INVENTION

An apparatus and method for stretch forming sheet metal, according to one embodiment of the present invention comprises complementary male and female die halves moveable between open and closed positions and a blank holder member moveable between open and closed positions relative to the female die half. There is further provided means for homogeneously stretching the sheet metal to form as the die halves are closed without also drawing the sheet metal. The stretching means includes a pair of grippers having mutually facing surfaces, one of the surfaces defining exactly two circumferential beads.

It is an object of the present invention to provide an improved apparatus and method for stretch forming sheet metal.

Related objects and advantages of the present invention will become more apparent by reference to the following figures and detailed description.

DESCRIPTION OF THE PREFERRED EMBODIMENT

Figure 1:
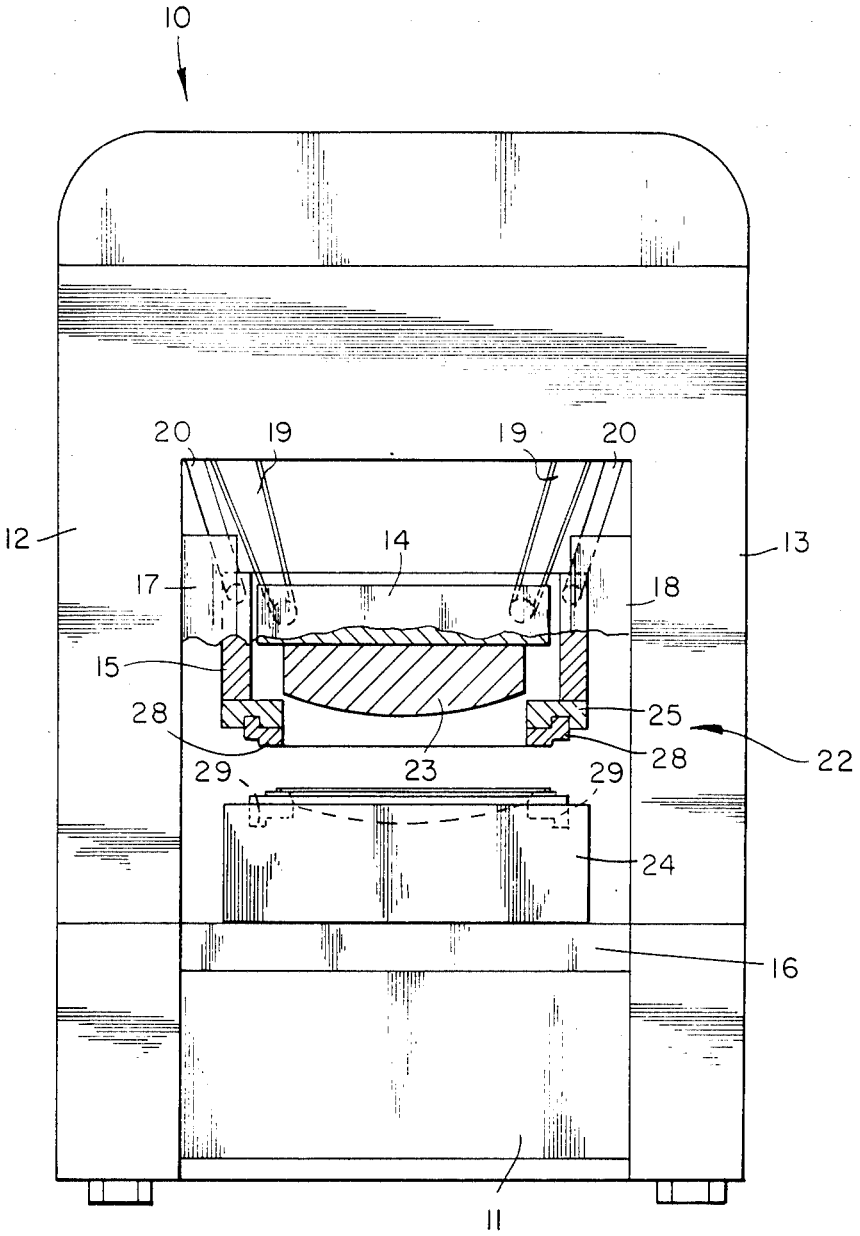
FIG. 1 is a front elevation view, partially in section, of the preferred embodiment of the present invention operably mounted in a conventional double action die press.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings in detail. FIG. 1 shows the preferred stretch form die apparatus mounted in a conventional 1000-ton double action die press generally designated at 10. Press 10, which is of the straight side type, includes a horizontally disposed bed 11 and two side supports 12 and 13 supporting inner ram 14 and outer ram 15. A bolster plate 16 is rigidly supported upon bed 11. Guides 17 and 18 guide inner ram 14 and outer ram 15 through reciprocal vertical movement. Rams 14 and 15 are moved up and down independently by separate linkages 19 and 20 which are in turn connected to flywheel assembleges not shown.

The stretch forming apparatus of the present invention is generally designated at 22 and includes complementary male and female die halves 23 and 24, respectively, and a blank holder member 25 which is more commonly referred to as a pressure or draw ring. Female die half 24 is rigidly mounted to bolster plate 16, while male die half 23 is carried by inner ram 14 and blank holder member 25 is carried by outer ram 15. A pair of grippers 28 and 29 are bolted to female die half 24 and blank holder member 25, respectively. Grippers 28 and 29 are vertically aligned and extend around the entire circumference of the sheet metal. Grippers 28 and 29 have mutually facing surfaces that serve to clamp the sheet metal therebetween in a manner fully described herein below.

Figure 2:
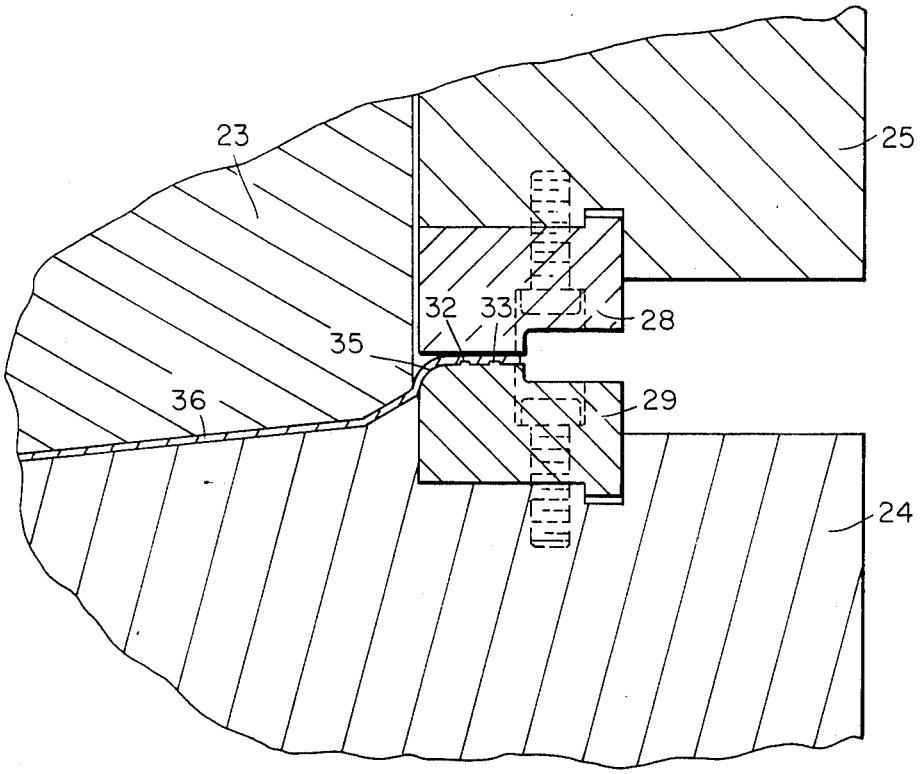
FIG. 2 is an enlarged fragmentary section view of the stretch form die of FIG. 1 showing the die in a totally closed position.
Figure 4:
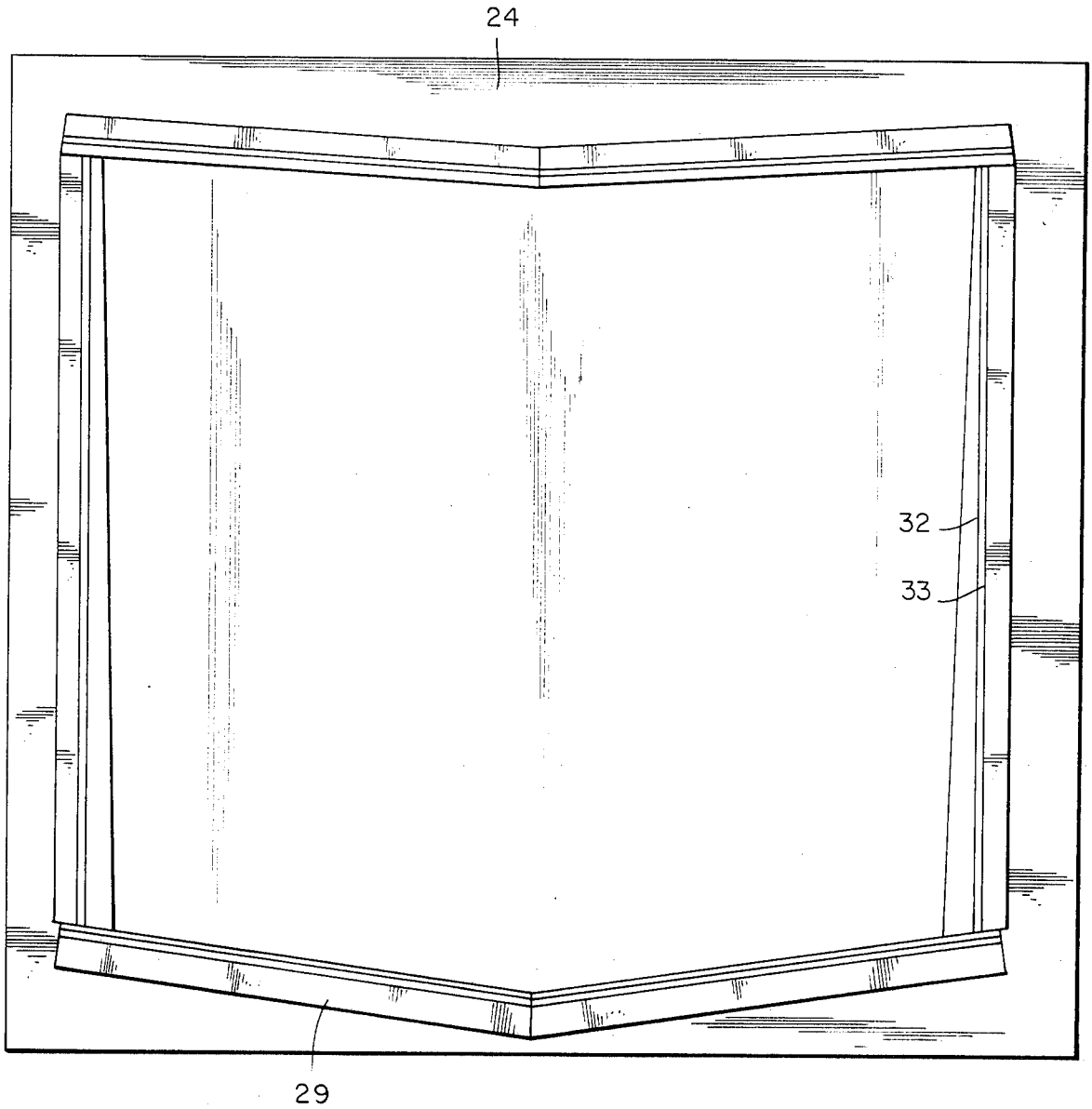
FIG. 4 is a top plan view of the female die half carrying the lower gripper as illustrated in FIG. 1.

As clearly seen in FIG. 2, a pair of similarly shaped parallel elongate protrusions or beads 32 and 33 is provided on gripper 29 and extends vertically upwards therefrom. FIG. 4 shows beads 32 and 33 extending entirely around the circumference of the formed portion of female die half 24. Beads 32 and 33 are shaped and formed so as to allow them to pierce or bite into the sheet metal in such manner that some metal will be forced into the space between the beads, thus increasing the thickness of the metal in the area between the beads. When this occurs, nearly the entire force exerted by the grippers is concentrated into the area between the beads, with the result that the sheet metal blank may be held without slippage while the part is being stretch formed.

Figure 3:
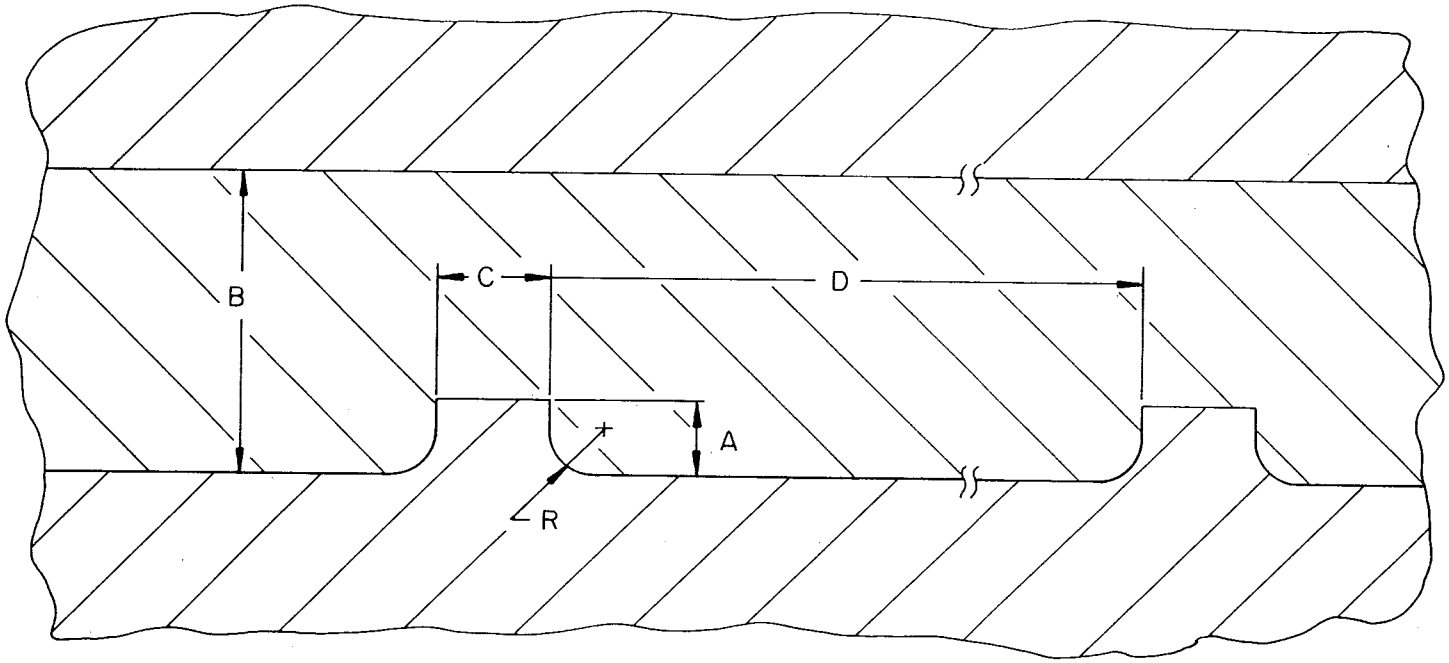
FIG. 3 is a fragmentary section view, enlarged from FIG. 2, showing certain features of the construction of the gripper beads.

FIG. 3 shows the construction of beads 32 and 33 in more detail. Each of the beads has a generally rectangular shaped cross section and defines a pair of relatively sharp edge surfaces 35 that provide the biting action as the sheet metal is clamped between the grippers. While it should be understood that the size, shape, and spacing of the beads may vary somewhat depending upon such factors as the size of the die press, the materials used to form the beads and the sheet metal blank, and the degree of stretching required to form the part, the following dimensional requirements are significant. The beads preferably have a height A which is approximately one fourth the thickness B of the sheet metal and a width C which is approximately 1–2 times the height of the bead. Also, the beads are spaced apart along their entire lengths a distance D which is approximately equal to 25 times the width of the beads.

By limiting the bead height to 25% of the sheet metal thickness a significant contribution is made to diminishing the problem caused by decreasing metal thickness in the area of the beads. This is believed to be due to the work hardening of the material as a result of the coining effect of forming the rectangular shaped grooves therein in the area of the beads.

In the embodiment shown, the stretch forming apparatus is adapted for stretch forming a conventional style automobile hood from 0.029 inch thick sheet metal material. The beads are formed of AISI D2 steel having a hardness of RC 60–62, a height A of 0.007 inches, a width C of 0.010 inches, and are spaced apart a distance D of 0.250 inches. Also, the lower portion of the beads are rounded to a radius R of 0.005 inches.

Gripper 29 is provided with a radiused bend 35 and beads 32 and 33 are positioned relative to the female die cavity and bend 35 such that as the die halves are closed the sheet metal blank must form around bend 35 before it can form to the die cavity. Thus, once the metal forms over bend 35, the resistance to slippage is substantially increased and the full tensile force is not transmitted back to the relatively thinner material in the section along inside bead 32. Bend 35 therefore ensures that beads 32 and 33 are capable of holding the sheet metal as it is stretched during forming. This condition can be perceived by referring to FIG. 2.

The operation of apparatus 22 in press 10 may be described as follows. A sheet metal blank 36 is positioned in press 10 so that it is supported by gripper 29 over female die half 24. Next, outer ram 15 carries blank holder member 25 vertically downwards towards female die half 24 causing grippers 28 and 29 to clamp sheet metal blank 36 therebetween. As member 25 closes fully relative to female die half 24, beads 32 and 33 pierce into blank 36, displacing an amount of metal into the space between the beads. This causes the thickness of the blank to be increased in the area between the beads, thus concentrating the force applied by the blank holder member into this area. Finally, inner ram 14 carries male die half 23 vertically downwards towards female die half 24. Since the blank is totally locked up around its entire periphery, it cannot draw as the male and female die halves close, with the result that the blank is homogeneously stretched to form.

It should be noted that the sheet metal blank may be either pre-cut prior to forming or may be fed into the press from a continuous coil or roll of sheet metal and formed while still attached to the coil. This allows the formed part to be removed from the press by advancing the coil, thus eliminating the use of iron hands devices or similar such means for removing the formed part.

It should also be noted that while the apparatus and method of the invention has been disclosed in use with a double action die press set up for a conventional draw, the invention is equally adaptable for single action presses and for conventional or inverted draws. Thus for example, if a single action press with inverted draw is desired, the relative positions of the male and female die halves would be reversed, with the beads extending downwardly from the upper gripper, and the blank holder member would float over the main die half on an air cushion mounted in the bolster plate.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

I claim:

1. A stretch forming apparatus, comprising:

complementary male and female die halves moveable between open and closed positions, said dies being arranged to stamp a blank therebetween with the female die half being of a closed configuration;

a blank holder member moveable between open and closed positions relative to said female die half and mounted about the entire periphery of the male and female die halves; and means on said blank holder, including a pair of grippers having mutually facing surfaces, one of said surfaces defining a blank holding surface and exactly two circumferential beads extending outwardly from and fixed relative to said blank holding surface in a direction towards the other of said facing surfaces, each of said beads including a sharp edge for biting into a sheet metal blank and the other of said facing surfaces lying entirely in a plane, for homogeneously stretching said sheet metal blank to form as said die halves are closed with the peripheral portions of the sheet metal blank extending outwardly of said beads fixedly held in position relative to said beads.

2. The stretch form die of claim 1 wherein said grippers are carried by said female die half and said blank holder member.

3. The stretch form die of claim 2 wherein said stretching means is arranged and disposed so as to permit said die to be operable with standard die presses used to similarly form sheet metal by conventional stretch drawing techniques.

4. The stretch form die of claim 3 wherein said grippers extend entirely around the circumference of said male and female die halves.

5. The stretch form die of claim 4 wherein each of said beads includes a pair of relatively sharp edges for biting into said sheet metal and said beads are equally spaced apart along their lengths.

6. The stretch form die of claim 5 wherein said beads are carried by said female die half.

7. The stretch form die of claim 6 wherein said beads are generally rectangular in shape.

8. The stretch form die of claim 7 wherein said beads have have a width C and are spaced apart a distance which is in a range of 15–35 times the width of C of said beads.

9. The stretch form die of claim 8 wherein said beads have a height A and the width C of said beads is approximately 1–2 times the height A of said beads.

10. The stretch form die of claim 9 wherein said beads are approximately 0.007 inches in height and are spaced approximately one quarter inch apart.

11. The stretch form die of claim 10 wherein the width of said beads is approximately 0.010 inches.

12. A method for stretch forming a sheet metal blank between male and female die halves without also drawing the sheet metal, comprising the steps of:

(1) locking the sheet metal blank around its entire circumference by relative closure of a first gripper having a first pressure applying surface lying entirely in a plane and a second gripper having a pressure applying blank holder surface and exactly two circumferential beads extending from said blank holder surface in a direction towards said first pressure applying surface and sinking said two circumferential beads into said sheet metal blank a distance approximately equal to one fourth the thickness of said sheet metal blank while maintaining said sheet metal blank planar throughout the surface of the blank which faces the first pressure applying surface so as to totally prevent slippage of the sheet metal blank as it is stretched; and (2) homogeneously stretching the sheet metal blank to form to the shape of the die halves by engaging the blank between complementary male and female die halves while the peripheral portions of said sheet metal blank are locked in place by relative closure of said first and second grippers.

13. The method of claim 12 and further comprising the step of:

(3) feeding the sheet metal blank into position from a continuous coil of sheet metal and performing said locking and stretching steps while said sheet metal blank is attached to said coil.

14. The method of claim 13 wherein said locking step includes relative closure of the female die half and a blank holder member prior to closure of the male and female die halves, said locking being accomplished by no more than two spaced apart beads extending around the entire circumference of the sheet metal blank.

* * * * *